United States Patent [19]

Zandmer, deceased et al.

[11] 4,285,398

[45] Aug. 25, 1981

[54] DEVICE FOR TEMPORARILY CLOSING DUCT-FORMERS IN WELL COMPLETION APPARATUS

[76] Inventors: Solis M. Zandmer, deceased, late of Freeport, The Bahamas; by Herbert M. Zandmer, executor, 1200 S. Flagler Dr., Apt. 1104, West Palm Beach, Fla. 33401

[21] Appl. No.: 86,522

[22] Filed: Oct. 19, 1979

Related U.S. Application Data

[63] Continuation of Ser. No. 953,119, Oct. 20, 1978, abandoned, which is a continuation of Ser. No. 743,070, Nov. 18, 1976, abandoned, which is a continuation-in-part of Ser. No. 565,363, Apr. 7, 1975, abandoned.

[51] Int. Cl.[3] ..... E21B 49/10

[52] U.S. Cl. ..... 166/100; 166/223; 166/270; 166/271; 175/58

[58] Field of Search ..... 166/100, 151, 205, 223, 166/269, 271, 307; 175/58

[56] References Cited

U.S. PATENT DOCUMENTS

| | | | |
|---|---|---|---|
| 2,855,049 | 10/1958 | Zandmer | 166/100 |
| 3,245,472 | 4/1966 | Zandmer | 166/100 |
| 3,362,477 | 1/1968 | Brandt | 166/307 X |
| 3,382,926 | 5/1968 | Zandmer | 166/100 |
| 3,390,724 | 7/1968 | Caldwell | 166/100 |
| 3,425,491 | 2/1969 | Zandmer | 166/100 |
| 3,434,537 | 3/1969 | Zandmer | 166/100 |

*Primary Examiner*—James A. Leppink

*Assistant Examiner*—Richard E. Favreau

*Attorney, Agent, or Firm*—Toren, McGeady and Stanger

[57] ABSTRACT

A duct-forming device is disclosed for use in a well completion apparatus of the kind, wherein a bore hole casing is positioned in a bore hole and duct-forming devices of alkali- and acid-resistant metal—such as steel—are secured at spaced levels to the casing in alignment with holes machined in the casing wall. In accordance with the invention, a closure device is arranged within the duct-forming device which permits flow of predetermined amounts of liquid, such as acid, from the interior of the casing through the duct-forming device and into the producing formation, while gradually being moved by the liquid into a position in which such fluid flow is prevented. After the fluid flow has been stopped by the closure device and when the formation pressure exceeds the pressure within the duct-forming device and the casing, fluid from the formation then forces the closure device toward and into the casing space to permit thereafter free flow of formation fluid into the duct-forming device and the casing or of pressurized treatment liquid from the casing into the formation.

The inventive arrangement permits inter alia the establishment of a sufficient and substantially uniform feeding rate of treatment liquid, such as acid, from the casing into the producing formation through all the duct-formers in preparation for subsequent acidification or other treatments, such as sand fracking.

38 Claims, 15 Drawing Figures

DEVICE FOR TEMPORARILY CLOSING DUCT-FORMERS IN WELL COMPLETION APPARATUS

This is a continuation of application Ser. No. 953,119 filed on Oct. 20, 1978, which in turn was a continuation of Ser. No. 743,070 filed on Nov. 18, 1976, which in turn was a continuation-in-part application of Ser. No. 565,363 filed Apr. 7, 1975, all now abandoned.

FIELD OF INVENTION

The invention is directed to well completion apparatus, and particularly to a mechanism for establishing a uniform feeding rate of treatment liquid from a casing to a producing formation and for temporarily closing communication between the casing interior and the formation.

BACKGROUND INFORMATION AND PRIOR ART

Bore hole casings or liners are conventionally set in bore holes by a cementing process in which a cement slurry is forced down through the casing space and then upwardly around the outside of the casing to fill the annular space between the exterior casing surface and the surrounding wall of the formation. After solidification of the cement, communication between the casing and the producing zone is established by explosive perforation of the casing, e.g., by means of bullets or shaped charges which also penetrate the hardened cement to form passageways or ducts therethrough. This procedure is unsatisfactory as the bullets or charges tend to crack the cement around the passageways, thereby causing vertical communication, to wit, up and down movement around the casing from one perforation to another. This, in turn, prevents subsequent selective treatment through each perforation to the formation at the end of each duct or perforation, since injected treating material could travel up or down through cracked cement without permitting selective control at the injected places, i.e., the stratum of the formation at the end of each duct.

It will be appreciated that this prior art method of establishing communication between the producing formation and the interior of the casing is particularly disadvantageous in respect of completion of the well bore, be it by acidification, sand fracking, consolidation and the like. The reason for this is that treatment liquid which is forced down the casing and through the passages in the cement into the formation, of course, travels along a path of least resistance. Liquid thus enters the formation where least resistance is offered, while no liquid, or only minor amounts of liquid will penetrate formation strata which offer more resistance. Moreover, large amounts of liquid are wasted within the cracks and fissures within the cement wall. The injection of treatment liquid thus takes place in a most non-uniform manner, and no uniform flow rate of liquid through the various passages leading from the holes in the casing and through the cement into the formation is accomplished. This is particularly disadvantageous, when some or all of the passages are to be selectively blocked by sealing means, usually referred to in the art as ball sealers. Thus, in practice, when it is desired to block off communication between the formation and the passages, which lead from the formation through the cement into the casing interior, ball sealers are suspended in the treatment liquid, the ball sealers having substantially the same specific gravity as the treatment liquid. The intention is for the ball sealers to enter the passages and to block them. However, since the flow rate is non-uniform, it will be appreciated that the ball sealers, of course, have the tendency to enter only those passages through which liquid flows at a sufficient rate while no balls will be forced into the passages through which there is only a trickle or no flow of treatment liquid.

More recently, an improved method and device for establishing communication between the casing and the producing zone has been suggested. According to this suggestion, a plurality of duct-forming devices are welded or otherwise secured to the outside of the casing in alignment with holes machined into the casing wall. These duct-forming devices comprise telescoping tubes or sleeves which are in a retracted position during the positioning of the casing in the bore hole. When contact with a producing zone is to be made, these telescoping tubes are caused to project substantially horizontally toward the formation wall to make contact with the pay zone and to establish a permanent link between the pay zone and the casing. The cement slurry is introduced into the space between the casing and the formation wall immediately before the lateral telescoping of the tubes so that the cement sets around the tubes and the casing. The telescoping tubes of the duct-forming devices, as previously proposed, are made of steel or the like acid- and alkali-resistant metal and the outer, free tube end which ultimately contacts the producing formation is blocked by an acid and/or alkali soluble metal plug which is lodged within the tube in a sealing manner so as temporarily to prevent passage of material through the tube. When communication between the pay zone and the interior of the casing is to be established, an acidic or alkaline liquid is forced down the casing and into the laterally extending telescoping tubes to cause dissolution of the plug.

The present invention is directed to an improvement of metallic duct-forming devices of the kind referred to hereinabove, such duct-forming devices having been disclosed in a number of U.S. patents, for example, Nos. 2,775,304, 2,707,997, 2,855,049, 3,245,472, and 3,425,491, to which specific reference is had.

While the duct-forming devices referred to above constitute an important improvement in the art of well completion and recovery of formation fluids, the known duct-forming devices still do not permit effectively to establish a sufficient feeding rate for treatment liquid into the formation. Thus, when the acid-soluble plug has been dissolved, treatment liquid such as acid or sand-containing fracking liquid, which is forced down the casing will enter the formation through the duct-forming devices also along a path of least resistance. Further, when blocking of selected duct-forming devices by ball sealers is intended, the non-uniform feed rate previously referred to also applies to well completion apparatus in which duct-forming devices of the prior art are used.

SUMMARY OF THE INVENTION

It is the primary object of the invention to overcome the disadvantages of the prior art procedures and devices referred to and to provide a duct-forming device with a closure mechanism which permits entry of liquid from the casing interior into the formation at a predetermined flow rate and in a predetermined volume, to prepare the formation for subsequent treatment, such as acidification, fracking and the like, and which blocks the communication between the formation and the casing interior when a sufficient feed rate for liquid from the casing into the formation has been established.

It is also an object of the invention to provide a closure mechanism of the indicated kind which, after the desired feed rate has been established, is removed from the duct-forming device and pushed into the casing and thus falls to the bottom of the well, when the formation pressure exceeds the pressure within the duct-forming device, so that formation fluids, such as petroleum or gas, can freely enter the duct-forming device and flow into the casing interior.

Generally, it is an object of the invention to provide improved apparatus for completing and treating wells.

Briefly, and in accordance with the invention, the duct-forming device has a terminal sleeve which is adapted to make contact with the producing formation. This terminal sleeve, at its outer free end, has at least one passage which may trasverse an acid and/or alkali-soluble plug, screwed or otherwise fitted into the free end of the terminal sleeve. This passage thus establishes communication between the formation and the interior space of the duct-forming device. A removable piston assembly is arranged within the interior space of the duct-forming device. This removable piston assembly includes a piston having passageways. The piston is movable between an initial position in which the piston is located away from the passage in the plug of the terminal sleeve so as to permit fluid flow through the passage of the plug, and a blocking position in which the piston blocks the fluid flow through the duct-forming device.

In one embodiment of the invention, the piston assembly, in addition to the piston proper, may include shoulder or abutment means which are press-fitted or otherwise removably lodged within the duct-forming device, and a spring having ends bearing against the shoulder or abutment means to urge the piston into its initial position away from the passage of the plug. This construction, moreover, comprises a flow-impeding member which is located behind the piston assembly of the casing, the flow-impeding member being in the form of a plate or the like, which is soluble in acid and/or alkali and thus prevents contact of liquid intended to flow from the casing interior into the duct-forming device until the flow-impeding member has been consumed or dissolved by acid or alkali.

Considering the very substantial hydraulic pressures with which well completion apparatus of the indicated kind are operated, the construction also includes a closure or safety cap which is screwed or otherwise secured to the end of the duct-forming device which is attached to the casing wall. This closure cap is also made of a material which is consumable by or soluble in acid and/or alkali and has at least one hole, preferably centrally located. Liquid forced down the casing thus enters the hole in the closure cap and makes contact with the flow impeding member. From a practical point of view it is advantageous to provide several holes in the closure cap in order to facilitate circulation and escape of gases which are evolved during the dissolution of the closure cap and the flow impeding member. When the liquid, be it alkaline or acidic, has eaten through the flow impeding member, the liquid thus flows through the passages in the piston and through the passage in the plug toward and into the formation where it breaks down and loosens the formation composition. The piston assembly construction is such that with increased pressure and/or volume of the liquid entering through the flow impeding member, the force of the spring will be ultimately overcome so that the piston of the piston assembly is gradually moved into its blocking position in which the piston blocks communication from the formation through the passage in the plug and into the interior of the duct-forming device. The system is now closed and when production is to be initiated, the pressure within the casing is relieved, for example, by swabbing, so that the formation pressure will exceed the pressure within the duct-forming device. Formation fluid now pushes the piston towards the casing and once the flow impeding member and the closure cap have been consumed or dissolved by the alkaline or acidic liquid, there is nothing to hold the piston assembly within the duct-forming device which thus is forced towards the casing where the piston assembly falls into the bottom of the bore hole. A free passage is now established for incoming formation fluids. It will be appreciated that due to this arrangement a sufficient flow rate into the formation can be established before the piston assumes the blocking position. When it is desired to close selected ducts and for this purpose, in accordance with prior art procedure treatment liquid is forced down the casing with suspended ball sealers, the ball sealers, due to the uniform flow rate through the several ducts located at various levels along the casing wall, enter each of these passages, and not only those through which liquid flows along a path of least resistance.

In accordance with some of the more specific embodiments of the invention, the piston assembly may be formed with differing configurations particularly with regard to the formation of passageways therethrough or therearound which operate to permit liquid to flow through and/or around the piston assembly after the flow-impeding member has been dissolved. For example, in one embodiment, the piston may be formed with internal passageways to which the liquid may flow. Alternatively, or in conjunction with the internal passageway, the piston assembly may be formed with a fluted piston structure which permits liquid flow about the exterior of the piston, simultaneously with or instead of flow through internal passageways.

By a further important aspect of the invention, the piston which forms the basic element of the piston assembly is itself made to be soluble upon sufficient exposure to the acid and/or alkali liquid. In this embodiment, a ball check arrangement is used to terminate flow through the duct forming device after the dissolution of the various parts of the device. This embodiment is generally similar to the previously described embodiments and includes a safety cap, flow-impeding means and a plug all of which are formed of material which is acid and/or alkali soluble. As the liquid is introduced into the casing, and after the telescoping duct-forming device has been extended to bring its forward end into contact with the formation wall, dissolution of the flow-impeding member will cause liquid to come into contact with the piston member, which, since it is no longer movable is more appropriately referred to as a check member. Although the check member is acid and/or alkali soluble, until the liquid actually is pumped through the casing, the check member will not dissolve because it is made with an outer casing which is very slowly soluble in the liquid.

When the well is to be stimulated and the liquid is pumped down the casing, a certain amount of flow wll be produced around the exterior of the check member and through the end plug. As the plug and the check member become dissolved, a ball check member originally located between the piston and the flow-impeding member will become seated upon a valve seat defined within the duct forming device thereby closing the flow path therethrough. However, as the pressure in the welbore is reduced, flow from the formation will displace the ball check allowing it to move into the casing and opening the passage for return flow.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

Figure 13:
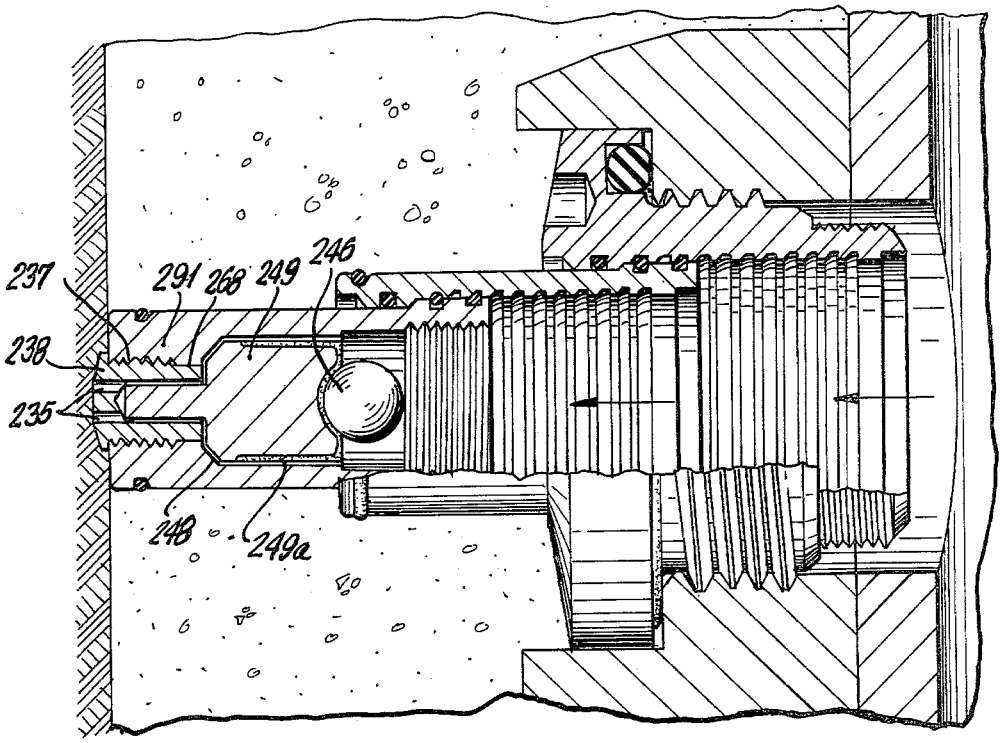
FIG. 13 is a view corresponding to that of FIG. 12 showing the device with the end cap and the flow impeding member dissolved but prior to dissolution of the check member.
Figure 14:
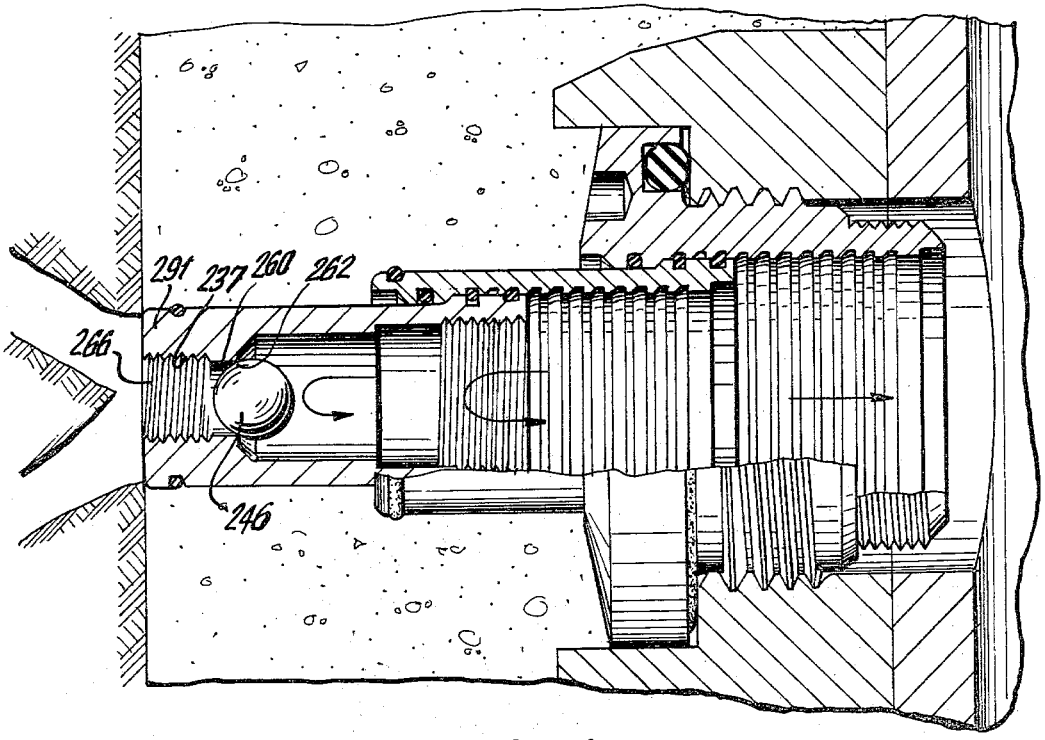
Figure 15:
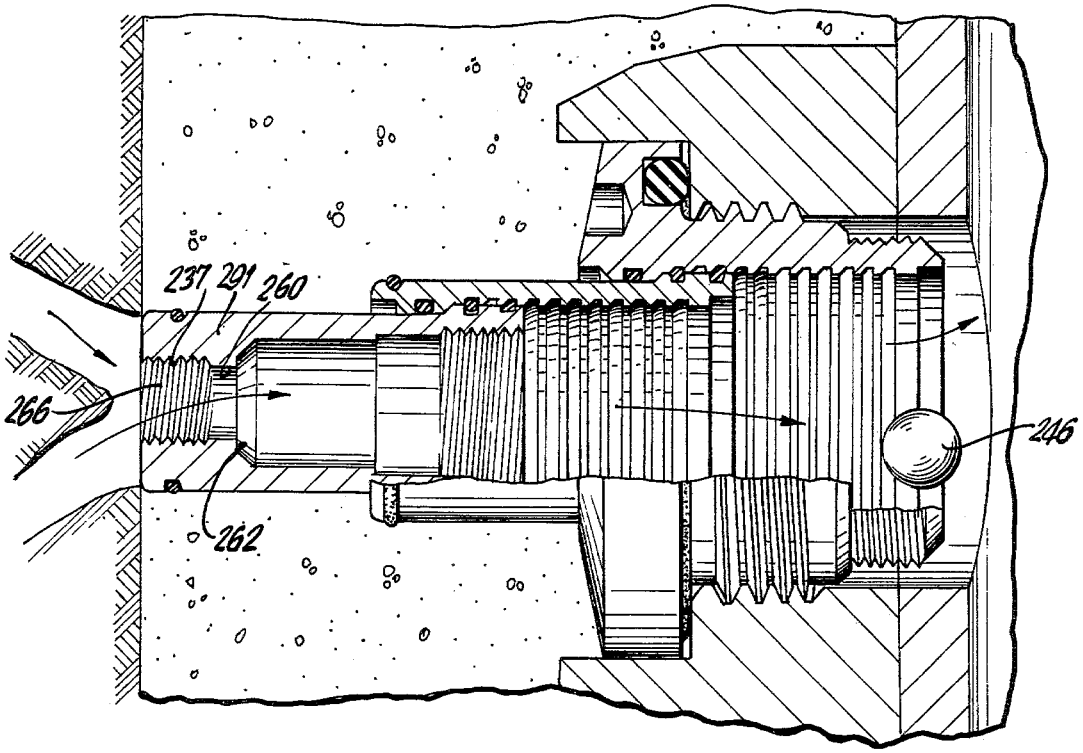

FIG. 14 is a sectional view corresponding with FIG. 13 wherein all of the soluble elements have been dissolved and with a ball check located to block flow through the duct-forming device; and FIG. 15 is a sectional view corresponding to the view of FIG. 14 showing the ball check being displaced from its seated position upon the occurrence of return flow through the duct-forming device from the formation.

DETAILED DESCRIPTION OF THE PREFERRED EMBODIMENTS

Figure 1:
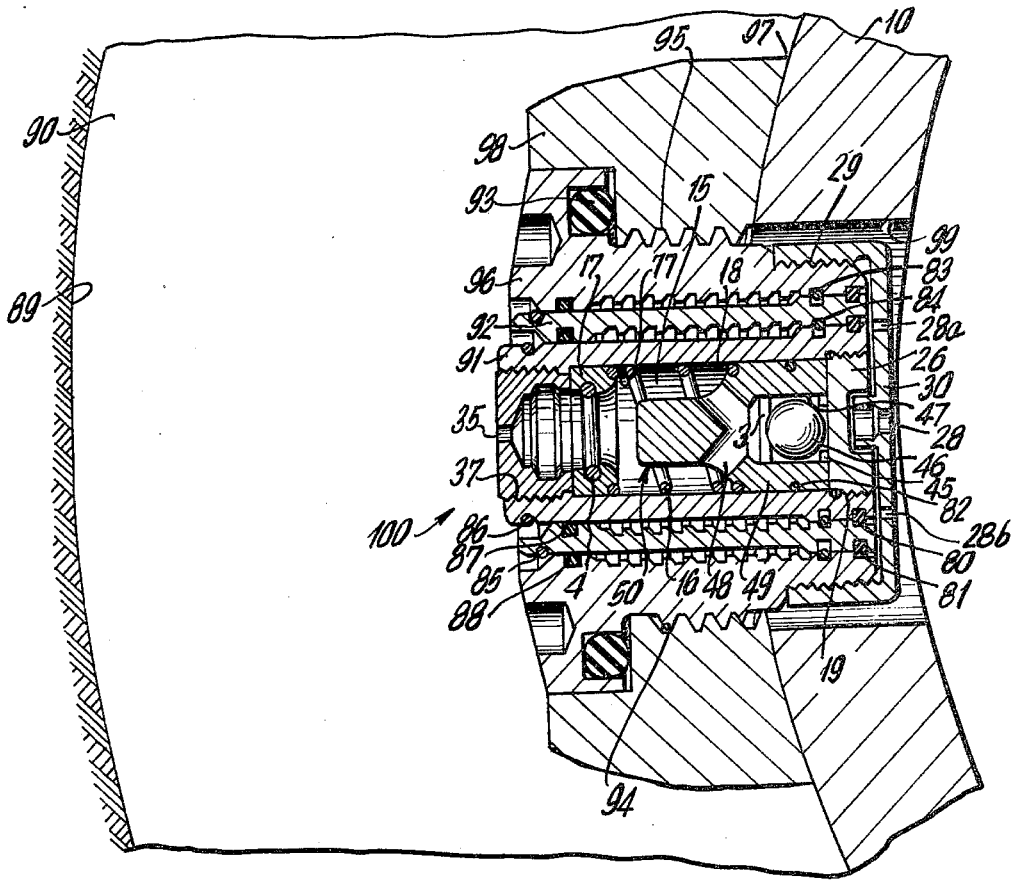
FIG. 1 is a sectional top view of a duct-forming device secured to a casing and positioned within a bore hole, the duct-forming device being in the initial, retracted position; p
Figure 2:
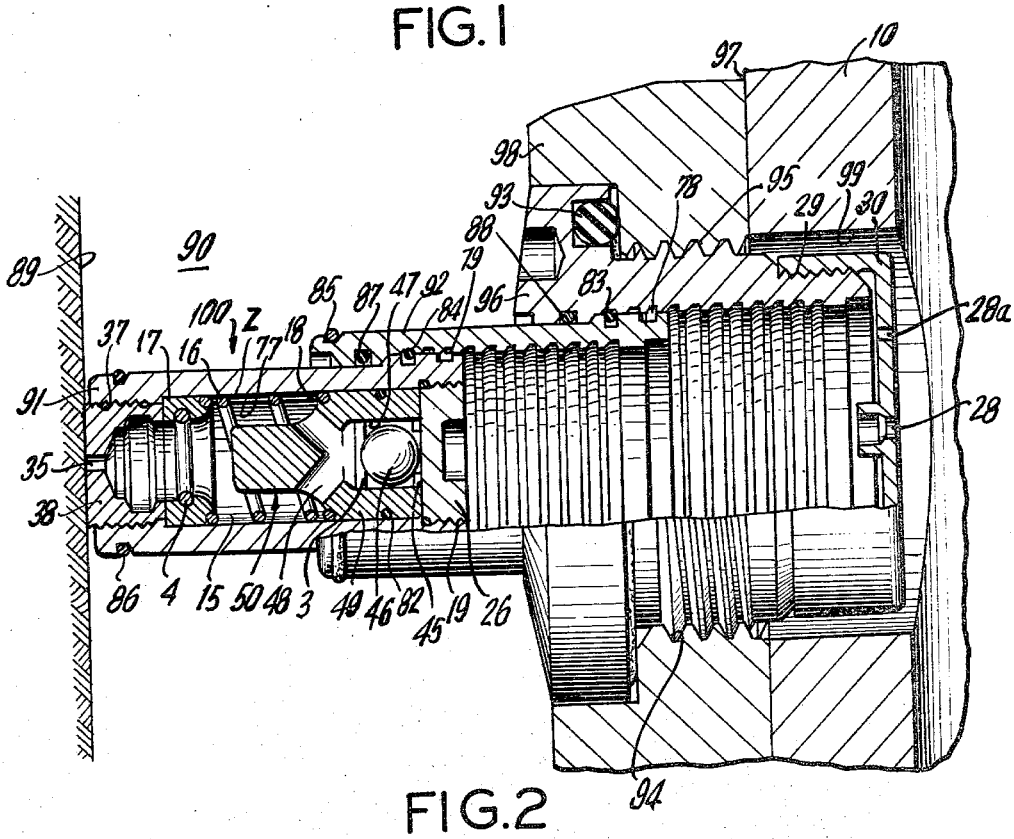
FIG. 2 is a longitudinal sectional view corresponding to that of FIG. 1 but showing the duct-forming device after it has been projected into its operative position toward the formation wall.

Referring now to the drawings, and in particular FIGS. 1 and 2, a duct-forming device, generally indicated by reference numeral 100, is secured to the external surface of a bore hole casing 10, which is shown fragmentarily only. For this purpose, the bore hole casing 10, which has a machined hole or opening 99, is provided with a nipple or mounting boss 98, which is welded or otherwise secured to the exterior casing surface, as indicated by reference numberal 97. The duct-forming device 100 has a hollow, cylindrical rear mounting portion 96, whose external threads 95 mesh with the internal threads 94 of the nipple 98. An O-ring or sealing means 93 is interposed between the rear mounting porton 96 and the nipple 98. The duct-forming device 100 comprises moreover two tubes or sleeves 92 and 91 which are arranged in telescoping manner and are shown in FIG. 1 in their initial or retracted position in which the casing is lowered into the well bore 90, the formation wall of the well bore being indicated by reference numeral 89.

In practice, many duct-forming devices 100 are secured to the casing 10 at spaced levels and locations thereof.

The construction so far described is similar to or the same as that of prior art duct-forming devices, such as, for example, disclosed in U.S. Pat. Nos. 3,245,472, 2,855,049, and 3,382,926.

The duct-forming device moreover comprises, in conventional manner several O-rings 4, 68, 87, 86, 85, 84, 83 and 82 for permitting the telescoping and ultimate positioning of the tubes or sleeves 92 and 91 in fluid-tight manner.

Shear rings or wires 81 and 80 are provided between the sleeves or tubes 92 and 91, the shear rings or wires being capable of breaking upon application of a predetermined pressure. Locking flanges or protruberances 79 and 78 prevent rearward movement of the sleeves 92 and 91 once they have reached their ultimate extended position.

The duct-forming device 100 defines an interior space or passage 77 which accommodates a removable piston assembly, generally referred to by reference numeral 50. The piston assembly comprises a piston proper 49 which defines one or several passages 48. The rear portion of piston 49 forms a chamber 47 which accommodates a ball 46. A seat 45 for the ball is located within the chamber 47.

A plug 38 is screwed into the free end of the sleeve 91, intermeshing threads 37 being provided for this purpose. It will be noted that the external surface of the plug 38 is substantially flush or in alignment with the outer extremity of the sleeve 91. The plug 38, which is preferably of acid or alkali soluble metal, has passageway means passing therethrough, one passage 35 being shown in the Figures. The interengaging threads 37 have a relatively lose fit so as to permit a trickle or light flow of fluid therethrough in the positions shown in FIG. 2.

The rear end of the duct-forming device 100 is fitted with a closure or safety cap 30 of a metal, for example, zinc, zinc alloy, aluminum or aluminum alloy, which is soluble by or consumable in acid or alkali. The closure cap 30 is screwed onto the mounting portion 96 of the duct-forming device, as indicated by the threads 29. This closure cap has at least one hole 28 which, as shown in the drawing, is centrally located. From a practical point of view it may be advantageous to optionally provide additional holes 28*a*, 28*b* closer to the circumference of the cap 30 as shown by way of example in FIG. 1. Between the cap 30 and the piston assembly 50 there is interpositioned a flow-impeding member 26, which is also made of a metal, for example, magnesium, magnesium alloy, aluminum, aluminum alloy, zinc or zinc alloy, which is soluble in acid and/or alkali. The flow impeding member, which is in the form of a plate, is screwed into the sleeve 91, as indicated by the threads 19. The piston 49 forms an abutment or shoulder portion 18, a second abutment or shoulder 17 being press-fitted into the front portion of the sleeve 91. A spring 16 bears against the shoulders 18 and 17 and thus urges the piston 49 towards the casing into contact with the flow-impeding plate 26.

The interior space 77 of the duct-forming device is initially preferably filled with a viscous liquid, such as petroleum jelly, indicated by reference numeral 15, thus preventing entry of substances from the bore hole.

The operation of the device is substantially as follows

After the casing, with the duct-forming devices 100 being secured thereto in the retracted position, has been positioned in the bore hole and prior to the setting of the cement which customarily fills the bore hole space between the formation wall 89 and the casing 10, the tubes or sleeves 92 and 91 of the duct-forming device 100 are projected towards the formation to assume the position shown in FIG. 2. This is done by pressurizing the casing, for example, with acidic or alkaline liquid which presses against the flow-impeding plate 26, the pressure being sufficient to break the shear wires 80 and 81. A more detailed explanation of the manner of extending the tubes or sleeves 91 and 92 is contained, for example, in U.S. Pat. No. 3,245,472, to which reference is bad. Since the projection of the tubes 91 and 92 into the position of FIG. 2 does not form part of the present invention, no additional explanation is necessary. Once the tubes have assumed their extended position of FIG. 2, they are held in this position by members 78 and 79.

After the duct-forming device 100 has been extended into the position of FIG. 2, the piston assembly 50, including the piston 49, still bears under the spring pressure of the spring 16 against the flow impeding member 26. The liquid which, as stated, may be of acidic or alkaline nature, is forced down the casing and enters the hole 28 in the closure cap 30 and gradually dissolves the flow impeding means 26 and the metal surrounding the hole 28 of the closure cap. It should be noted in this context that due to the very significant pressure customarily employed for the liquid, the construction including the safety or closure cap 30 having a centrically located hole or bore is particularly advantageous to prevent the tubes of the duct-forming device from being hurled out towards the formation.

Figure 3:
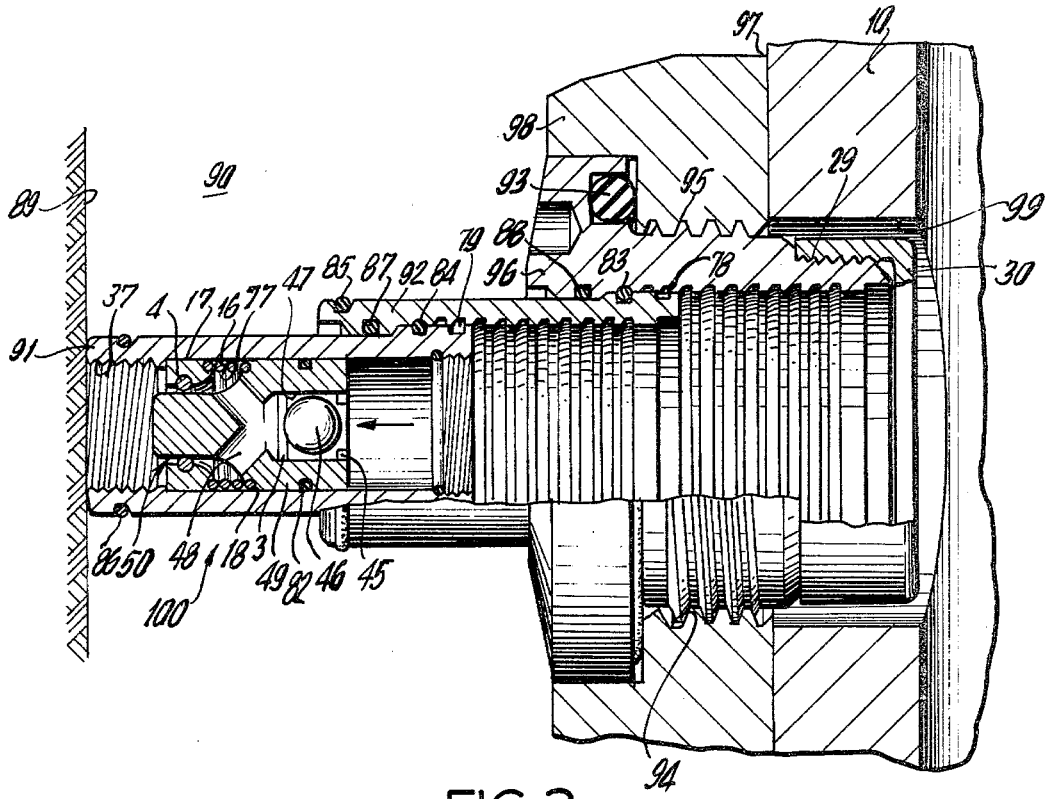
FIG. 3 is a view corresponding to FIG. 2 with the piston in the blocking position.

Once the liquid has eaten through the flow impeding member 26 to a sufficient degree so as to pass therethrough, the liquid flows through the passages 48 in the piston 49, thus forcing out the viscous liquid 15 through the passage 35 in the plug 38. The liquid thus enters the formation where it breaks up the formation structure. In the initial stages, when the flow impeding member 26 has been eaten through to a partial extent only and thus still offers resistance, the flow of liquid through the interior space 77 of the duct-forming device will be rather slow and the amount of liquid entering the formation will thus be relatively small. However, it will be appreciated that once the flow-impeding member and the closure cap have been substantially dissolved by the liquid, the flow of liquid gradually increases until the pressure of the liquid entering the interior space 77 of the duct-forming device is sufficient to overcome the spring action of the spring 16 and to push the piston 49 against this spring action to such an extent that the piston 49 is gradually moved from its initial position of FIG. 2 into the position shown in FIG. 3, in which the piston thus blocks the flow passage through the duct-forming device. As shown in FIG. 3, this occurs as a result of engagement of the piston within the O-ring 4. Of course, it will be seen that until this point sufficient liquid has flowed to substantially or completely dissolve the plug 38 thus leaving the duct forming device capable of permitting return flow. The engagement between the piston 49 and O-ring 4 prevents also leakage of fluid through the threads 37. In this position which, as stated, is shown in FIG. 3, the ball 46 is retained within the chamber 47 by a suitable retaining member 3. The movement of the piston 49 from the position of FIG. 2 to that of FIG. 3 is thus dependent on the amount and pressure of the liquid. These criteria can be readily adjusted by the operator thus enabling entry of predetermined amounts of liquid into the formation before the passage through the duct forming device is blocked by the piston 49.

It will also be appreciated that the effect and action are essentially the same in all the duct-forming devices mounted on the casing 10 and that, when the piston assemblies of all the duct-forming devices have assumed the position of FIG. 3, substantial amounts of treatment liquid have already passed into the formation to break up the formation, thereby establishing a substantially uniform flow rate into the formation from the casing through all the duct-forming devices.

Communication between the formation and the casing has thus been effectively blocked when the piston assemblies of the duct-forming devices have assumed the position of FIG. 3.

Figure 4:
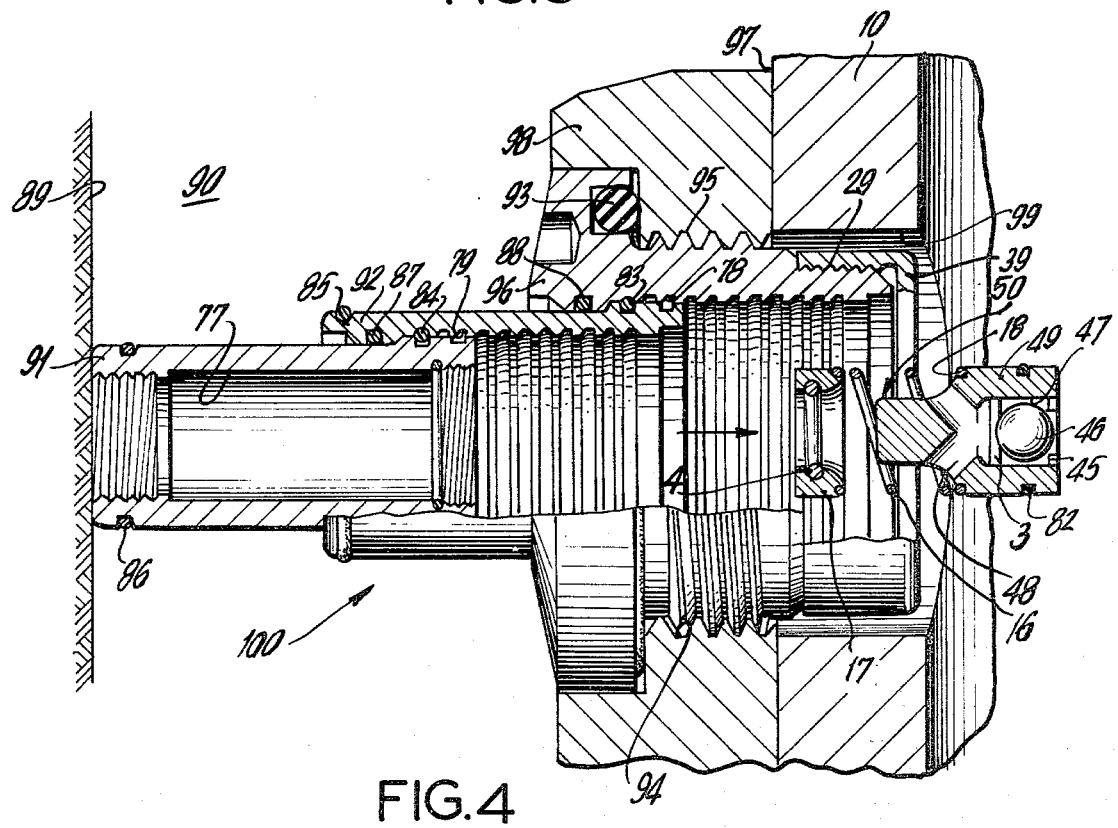
FIG. 4 is a view corresponding to FIG. 3 with the piston assembly on its way to the ultimate position on the bottom of the wellbore.

When production is to be initiated or when further treatment of the formation is desired, for example, by acidification or fracking, for example, sand fracking, it is, of course, desired that the interior space of each of the duct-forming devices is substantially clear so as to permit free flow of fluids. Accordingly, and pursuant to the invention, the piston assembly of the duct-forming device should be removed. Since the procedure so far described is relatively time-consuming, it will be appreciated that the plug 38, the flow impeding member 26 and the closure cap 30 have at this stage been substantially completely dissolved. This means that there is nothing to prevent the piston assembly 50 from moving towards and into the casing interior, provided, of course, sufficient pressure is exerted in the direction towards the casing. Accordingly, in order to remove the piston assembly, pressurization is discontinued and the casing may be swabbed to a point at which the formation pressure is greater than the pressure within the casing interior and the inner space of the duct-forming device. When this occurs, formation fluid, enters the duct-forming device to push the entire assembly 50 toward and into the casing. In order to facilitate the removal of the piston assembly, the ball 46 is provided which is thus forced against its seat 45 to offer additional resistance thus building up the pressure and facilitating removal of the entire piston assembly, as indicated in FIG. 4, in which the piston assembly 50, including the spring, are just in the process of falling into the casing and to the bottom of the well bore.

It will be understood that if treatment or stimulating liquid is now again forced down the casing and its pressure exceeds the formation pressure, the treatment liquid will freely and uniformly flow through all the duct-forming devices and the problem of flow according to the path of least resistance is essentially minimized, if not entirely overcome. Ball sealers suspended in treatment liquid will enter each of the duct-forming devices. If sand fracking is intended and, depending on the size of the duct-forming devices, large volumes of sand can be readily introduced into the formation through the inventive duct-forming devices.

Since the duct-forming devices are subject to substantial friction and abrasive forces, both during the positioning of the casing—the duct-forming devices rub against the formation wall—and during the subsequent treatment procedures, for example, sand fracking, it is recommended to make the entire duct-forming device, or at least those portions which are subjected to wear and friction of hardened steel. Moreover, it may be preferred to line the interior passage of the duct-forming devices with wear-resistant lining material, such as, for example, tungsten or ceramic material as indicated at Z in FIG. 2.

Figure 5:
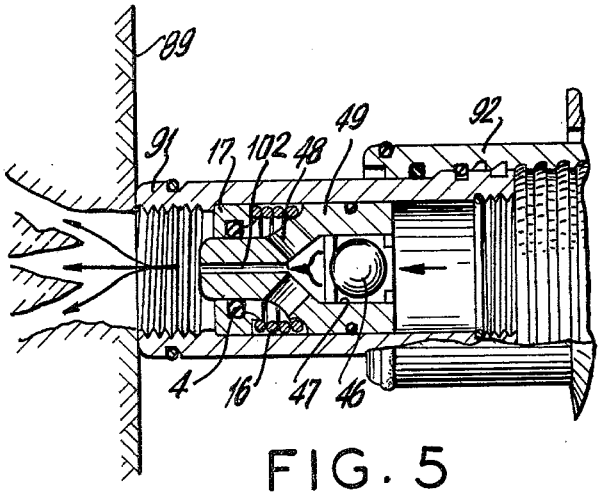
FIG. 5 is a partial sectional view of the duct-forming device of the invention showing a configuration of the piston in accordance with an alternative embodiment of the invention.

A further embodiment of the present invention is shown in FIG. 5. The embodiment depicted in FIG. 5 differs from the embodiment of FIGS. 1–4 in that a bleed hole 102 is provided through the piston 49. The embodiment of FIG. 5 is essentially identical with the previously disclosed embodiment except for the fact that after the nose of the piston 49 becomes engaged within the O-ring 4 to terminate the main flow of liquid through the duct-forming device, a small amount of bleed liquid continues to flow through each of the duct-forming devices 100 by virtue of the bleed hole 102. As will be seen from FIG. 5, liquid flowing through the duct-forming device will flow through the passages 48 but this flow will be blocked by virtue of the engagement of the outer surface of the nose of the piston 49 within the O-ring 4. However, since the bleed hole 102 is located centrally of the piston, fluid entering the chamber 47 will be by-passed around the blocking engagement between the piston nose and the O-ring 4 and will be permitted to flow into the formation as indicated. It should be understood that the size of the hole 102 determines the quantity of liquid which is permitted to flow into the formation and it should be considered that the hole 102 is to be made rather small and constitutes a bleed hole wherein a controlled amount of additional liquid may be permitted to leak or bleed into the formation. Otherwise, the operation of the embodiment of FIG. 5 is essentially identical with that described in connection with the embodiment of FIGS. 1–4.

Figure 6:
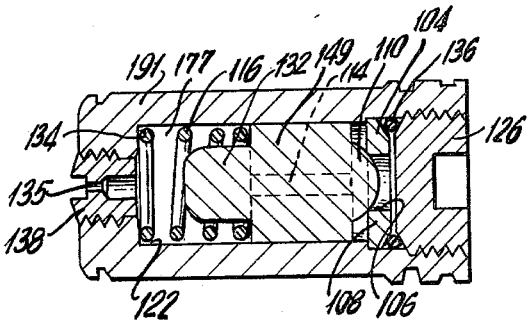
FIG. 6 is a partial sectional view showing a further embodiment of the invention wherein there is utilized a fluted piston devoid of internal passages.
Figure 7:
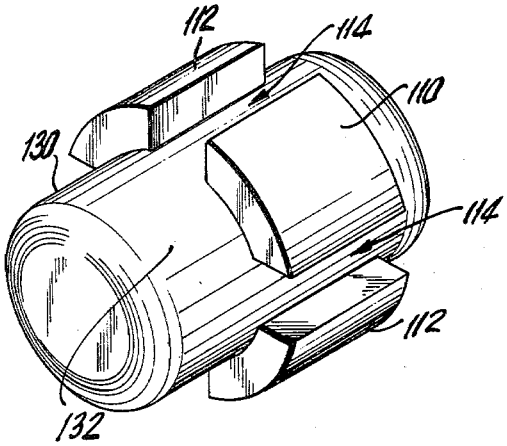
FIG. 7 is a perspective view of the fluted piston utilized with the embodiment depicted in FIG. 6.

Another embodiment of the present invention is depicted in FIGS. 6 and 7. In the embodiment of FIGS. 6 and 7 a piston 149 is utilized which is formed with a fluted outer configuration with the overall arrangement of this embodiment being such that the need for a ball check is eliminated. The embodiment of FIGS. 6 and 7 is essentially similar to the embodiments previously described except for the outer configuration of the duct-forming device which extends into abutment with the wall 89 of the formation. As indicated in FIG. 6, the embodiment depicted therein is formed with a flow impeding member 126 similar to the flow impeding member 26 of the previously described embodiment. A sleeve 191 which constitutes the terminal sleeve of the telescoping duct forming device and which is essentially analogous to the sleeve 91 of the previously described embodiments, has formed therein an interior passage 177 defined by an inner cylindrical wall 122. The piston 149 which is slidably positioned within the interior passage 177 is formed with a basically cylindrical body structure 130 and with a forward nose portion 132 and a rearward closure member 110. A plurality of flutes 112 are positioned about the outer surface of the piston with axially extending spaces being provided between the flutes. The flutes 112 are shaped with a generally trapezoidal cross sectional configuration and with their outer curved surfaces essentially conforming with the curvature of the wall 122. Thus, with the piston 149 in position within the passage 177, as indicated in FIG. 6, a plurality of axially extending flow passages 114 will be formed between the flutes 112 with one side of the flow passages being defined by the wall 122.

The piston 149 is biased rearwardly or to the right, as seen in FIG. 6, by a spring 116 which is engaged between the left faces of the flutes 112 and a shoulder 134 formed within the sleeve 191. The biasing force of the spring 116 urges the piston against a check disc 104 having an opening 106 defined therethrough and also having defined thereon a valve seat 108 against which the closure member 110 of the piston 149 may become seated. By virtue of the urging force of the spring 116, the closure member 110 will become engaged against the seat 108 tending to close off liquid flow through the orifice 106.

During the operation of the device, and referring back to the description previously set forth herein, dissolution of the flow-impeding member 126 will cause liquid to impinge against the closure member 110. Depending upon the fluid pressure of the liquid and upon the spring biasing force of the spring 116, the piston 149 will tend to move leftwardly with increased liquid pressure thereby tending to unseat the closure member 110 from the seat 108. As a result, liquid will tend to flow through the orifice 106 and through the passages 114. Depending upon the fluid pressure of the liquid, the piston may become further urged laterally against the force of the spring 116 tending to maintain the liquid flow through the passage 177. If the fluid pressure of the liquid being introduced into the casing 10 is properly maintained, the piston 149 may be held in balance between its left-most and right-most position and during this time the acid and/or alkali liquid will flow through the duct-forming device and through the passage 177 into the formation.

The left end of the sleeve 191 is fitted with a plug 138 similar to the plug 38 of the previously described embodiments which includes a passage 135. The plug 138 may be made of acid and/or alkali soluble material and when sufficient liquid flow through the passage 177 has occurred, the plug 138 will dissolve thereby opening the end of the sleeve 191.

When adequate liquid has been caused to flow into the formation through the passage 177, the liquid pressure within the casing 110 may be increased to completely overcome the force of the spring 116. When this occurs, the nose 132 of the piston 149 will be brought into abutment with the end of the sleeve 191 thereby closing off any further liquid flow from the casing into the formation. As long as the liquid pressure within the casing 10 is maintained at an adequate level, the piston 149 will be pressed against the end of the sleeve 191 and the nose 132 will block the opening therein and prevent further liquid flow into the formation.

When it is desired to reverse the flow through the duct-forming device, the liquid pressure within the casing may be diminished and when the pressure of the liquid within the formation is high enough, a reverse flow will occur and the piston 149, the check disc 104 and the spring 116 will be driven through the duct-forming device and into the casing in a manner similar to that previously described in connection with the piston assembly 50 and depicted in FIG. 4. It will be noted that once the flow impeding member 126 has become dissolved, the check disc 104 will be free to move rightwardly as viewed in FIG. 6 and the check disc as well as an O-ring 136 will be driven backwardly through the duct-forming device and into the casing 10.

It will be noted that in the embodiment of FIGS. 6 and 7, a mode of operation basically similar to the operation of the previously described embodiments is involved except that the need for a ball check such as the ball 46 is eliminated and except for the fact that the piston configuration is somewhat different. In either case, flow through the duct-forming device into the formation of the acid and/or alkali liquid is terminated by operation of the piston, such flow having been induced after dissolution of certain acid and/or alkali soluble members. When it is desired to effect a reverse flow from the formation, the members located within the duct-forming device may be readily displaced therefrom and drawn into the casing by the flowing liquid.

Figure 8:
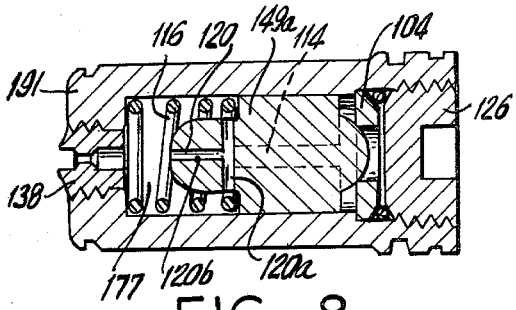
FIG. 8 is a partial sectional view showing still another embodiment of the invention wherein there is utilized a fluted piston having internal passageways.
Figure 9:
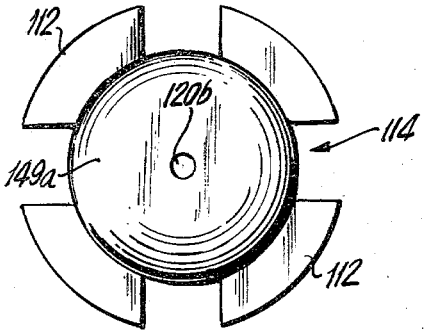
FIG. 9 is an end view of the piston utilized in the embodiment depicted in FIG. 8.
Figure 10:
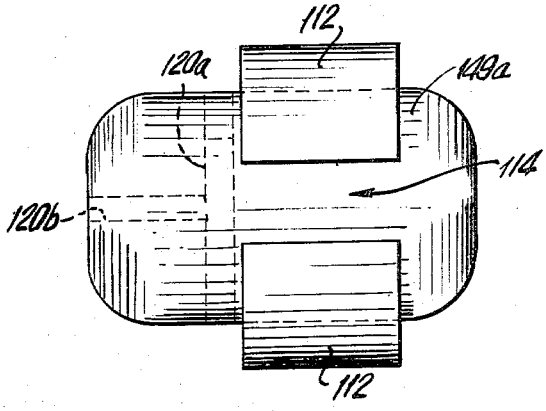
FIG. 10 is a side elevation of the piston shown in FIGS. 8 and 9.
Figure 11:
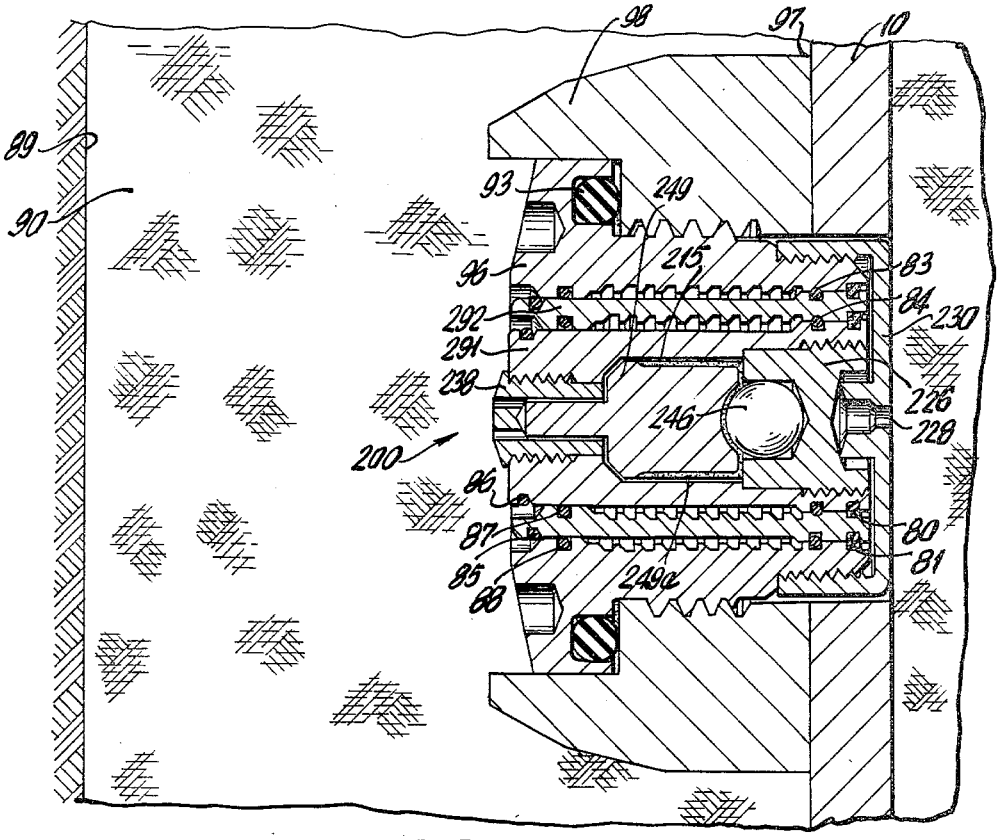
FIG. 11 is a sectional view of a different embodiment of the duct-forming device of the present invention wherein a soluble check member is utilized with the device being shown in a position similar to the position depicted in FIG. 1 secured to the casing with the duct-forming device in its initial, retracted position.

A still further embodiment of the invention is shown in FIGS. 8, 9 and 10. The embodiment of FIGS. 8, 9 and 10 differs from the embodiment of FIGS. 6 and 7 essentially only in the inclusion of bleed holes which will permit some flow of liquid into the formation after the piston has moved to block further flow of the acid and/or alkali liquid through the duct-forming device. In this sense, the embodiment of FIGS. 8, 9 and 10 is essentially the embodiment of FIGS. 6 and 7 including a modification of the type provided by the embodiment of FIG. 5.

In the embodiment of FIGS. 8, 9 and 10, there is provided a piston **149*a* which is essentially identical with the piston 149 of FIGS. 6 and 7 except that there is included a bleed passage 120 comprising a pair of bleed channels 120*a* and 120*b*. Except for the inclusion of the bleed passage 120, the piston 149*a* is identical in structure and operation with the piston 149. In the operation of the device of FIGS. 8, 9 and 10, when the piston 149*a* has been moved leftwardly into abutment with the end of the sleeve 191 to block the main flow of acid and/or alkali liquid through the flow channel 177 of the duct-forming device, a certain amount of liquid will bleed or trickle through the bleed passage 120 and into the formation. It will be clear that the piston 149*a* is essentially identical in all other regards with the piston 149 and that the bleed passage 120 operates in a manner basically similar to the bleed hole 102 of the embodiment of FIG. 5. Thus, after the piston 149*a* has been moved leftwardly to block the main flow of acid and/or alkali liquid through the passage 177, the amount of liquid which is permitted to bleed into the formation will be determined by the size and configuration of the passage 120 including the channels 120*a* and 120*b*. Of course, the piston 149*a* is formed with the flutes 112 defining the axial flow passages 114 and when the piston is moved to its left-most position, the liquid will first flow through passages 114 and then through the bleed passage 120** into the formation.

Of course, when reverse flow from the formation occurs, the piston **149*a*** and associated parts will be drawn backwardly into the casing in a manner similar to that previously described with other embodiments of the invention.

A further embodiment of the invention involving more significant structural modifications is depicted in FIGS. 11–15. This embodiment essentially differs from the previous embodiment at least by virtue of the fact that the piston member is itself replaced by a check member which is soluble in the acid and/or alkali liquid.

In the embodiment of FIGS. 11–15 there are provided many elements which are identical with elements provided with the embodiment of FIGS. 1–4. In this embodiment the casing 10 is provided with a nipple or mounting boss 98 welded or otherwise mounted thereto as at 97. A cylindrical rear mounting portion 96 is provided as well as an O-ring 93 interposed between the rear mounting portion 96 and the nipple 98. The duct-forming device of FIGS. 11–15, generally designated by the reference numeral 200 comprises moreover a rear closure cap 230 similar to the closure cap 30 of FIGS. 1–4 and a pair of tubes or sleeves 291, 292 which are at least quite similar in their structure and operation to the sleeves 91, 92 of FIGS. 1–4. As will be apparent from the description which follows, the general overall mode of operation of the embodiment of FIGS. 11–15 is quite similar to that of the embodiment of FIGS. 1–4. The embodiment of FIGS. 11–15 includes similar elements such as O-rings 83, 84, 85, 86, 87 and 88 for permitting telescoping and ultimate positioning of the sleeves 291, 292 in a fluid type manner. Furthermore, shear rings 80 and 81 are also provided between the sleeves or tubes 291, 292 with locking flanges 78, 79 operating, in a manner similar to those of the embodiment of FIGS. 1–4 to prevent rear movement of the sleeves 291, 292 once they have reached their ultimate extending position.

Figure 12:
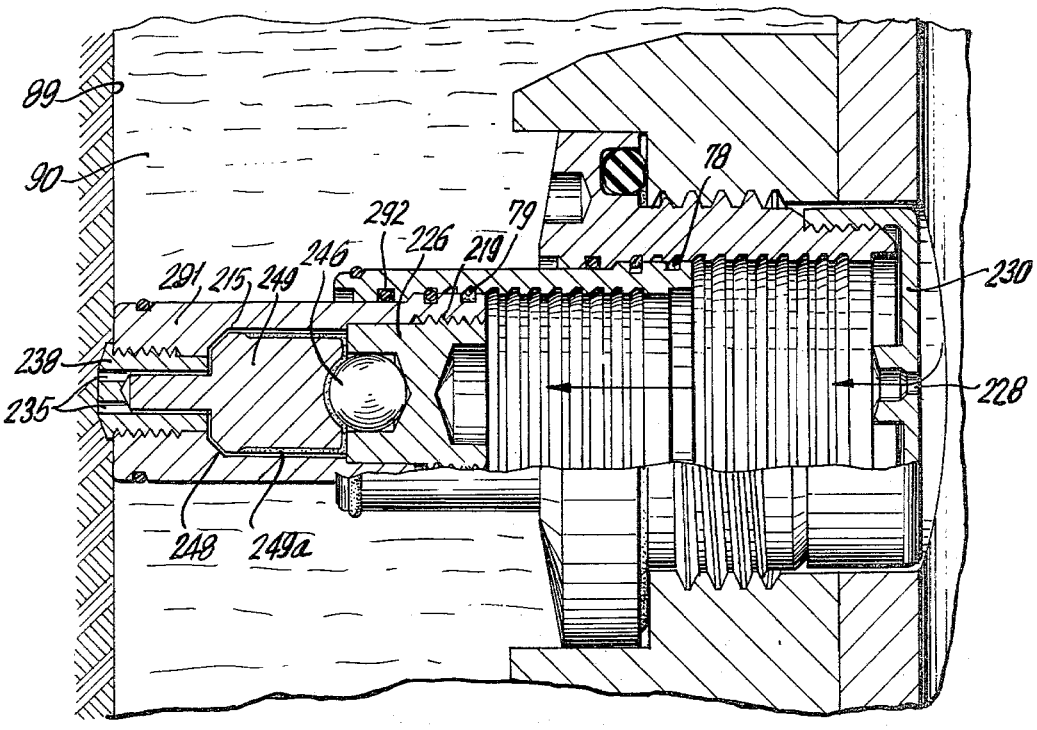
FIG. 12 is a sectional view corresponding to that of FIG. 11 but showing the duct-forming device after it has been projected into its operative position toward the formation wall.

A plug 238 is screwed into the free end of the sleeve 291 and it will be noted, particularly from FIG. 12, that when the duct-forming device 200 is in its extended position, the left hand end of the sleeve 291 and the plug 238 will be in contact with the bore wall 89 of the well bore 90.

Positioned within the duct-forming device 200 is a flow-impeding member 226 and a check member 249 with a ball 246 interposed therebetween. The flow impeding member 226 is screwed into the sleeve 291 as indicated by threads 219.

After the cement which customarily fills the bore hole space is in place, the duct-forming device 200 is projected to its telescoped position depicted in FIG. 12 in a manner similar to that previously described. A plug may be seated in the bottom of the casing 10 and the duct forming devices may be extended by pressurizing the inside of the casing to a pressure of about 1500 to 2000 psi greater than that which obtains in the column of wet cement in the annulus between the casing and the formation at a subsurface depth equal to that at which the duct-forming devices are fixed to the casing. This pressure is sufficient to shear the rings 80, 81 holding the duct-forming devices in their nested mode. When the rings are sheared, water or mud being used to pressure the inside of the casing 10 will flow through the orifices 228 in the closure caps 230 forcing the sleeve 291 of the duct-forming device against the formation wall. The device is provided with locking flanges 78, 79, or similar check rings or the like, which will prevent the assembly from moving away from its contact with the formation even though the pressure inside the casing may be reduced.

After the cement has hardened and the operators desire to complete the well, the mud or water in the casing is displaced with the acidic and/or alkaline liquid. The liquid is allowed to remain in the casing for a sufficient time to dissolve the rear closure cap 230. In addition, the liquid also operates to dissolve the flow-impeding member 226.

The piston or check cylinder 249 is made of acid and/or alkali soluble material. However, the ball check 246 is not. So long as the acid is not pumped through the duct-forming devices, the check cylinder or piston 249 will not dissolve because the side of the check member closest to the casing 10 is made of a material which is very slowly soluble in acid. Thus, in forming the member 249, it may be desirable to make its rightmost end as viewed in FIG. 12, from a material which dissolves more slowly in the acid than the other parts of the check member 249. In a preferred embodiment of the invention, the member 249 is formed with a coating 249*a* of more slowly soluble material. This may be accomplished in a number of methods such as coating the rear end of the member 249 with a plastic or utilizing a member which is coated with a slowly soluble metal alloy. Of course, other similar expedient obvious to those skilled in the art may be used.

The spacing between the outer walls of the member 249 and the inner walls of the sleeve 291 is filled with grease or other similar substance indicated at 215. When the well is to be stimulated, acid is pumped down through the casing and into the duct-forming devices. The acid will displace the grease 215 which fills the interior spaces between the piston 249 and the sleeve 291 and the acid will then flow around the piston 249 and through orifices 235 extending through the plug 238. As will be noted from FIG. 12, the member 249 is configured so that certain spacing will be provided between the inner walls of the plug 238 and of the sleeve 291 and the outer surface of the member. As a result thereof, passage means 248 extending around the exterior of the member 249 will be provided. It will therefore be apparent that the check member 249 essentially constitutes a restriction in the passageway means of the terminal sleeve 291.

After dissolution of the flow-impeding member 226, the device of the invention will be in the condition depicted in FIG. 13. As the acid is pumped down the casing, and after the grease which fills the spaces between the check member and the sleeve 291 has been displaced, the acid will flow around the member 249 through the passages 248 and through the orifices 235 in the plug 238. The member 249 and the plug 238 may be made of acid and/or alkali soluble material, for example, an acid soluble metal such as magnesium, aluminum, zinc, etc. and as the acid flows these elements will be slowly dissolved.

The body proper of the member 249 and the external coating may be formed of a composition such as to prevent the ball 246 from closing the duct forming devices until a predetermined volume of acid has passed through the duct-forming device into the formation. For example, in laboratory tests, check members made of a zinc-tin-lead-copper alloy dissolve in about two hours thus preventing the ball 246 from closing during this time. Acid flowed through a test duct-forming device formulated in accordance with the present invention at an initial rate of a few gallons per minute and this rate was increased to a final rate approaching 42 gallons per minute (one barrel per minute). The average rate of 20 gallons per minute resulted in a total acid throughput of about 2400 gallons through the device.

In the example referred to, the acidization treatment of each duct-forming device would allow about 2400 gallons to add to the formation at each of the duct-forming device locations before the device was closed.

The closing of the duct-forming device occurs as a result of engagement of the ball check 246 against a valve seat formed interiorly of the sleeve 291. The preferred embodiment for the ball check 246 is a composition of a relatively rigid core with a resilient outer covering. The sleeve 291 is formed with internal threads 237 which engage the plug 238. Adjacent the threads 237 there is formed an annular wall 260 having a diameter smaller than the diameter of the ball 246. As a result, a valve seat 262 is defined about the periphery of the annular wall 260. When the plug 238 is dissolved, as indicated in FIG. 14, an orifice 266 extending to the end of the sleeve 291 will be formed by the threads 237 and the annular wall 260. As the member 249 becomes totally dissolved by the acid flow previously described, the ball 246 will become seated against the seat 262 thereby closing the orifice 266 and preventing additional acid flow through the duct-forming device. The rigid core of the bass 246 prevents the ball from being forced through the orifice or hole 266 at the front end of the sleeve 291. The resilient covering on the ball 246 facilitates a tight closure against the seat 262.

As each of the duct-forming devices closes in a manner indicated in FIG. 14 by abutment of the ball 246 against the seats 262, the acid which is forced into the casing will enter the formation through the remaining duct-forming devices which are still open and which have not as yet had any appreciable acid through put. This results in acidization of all the duct-forming device locations thus allowing fluid flow from the casing into the formation at the maximum pressure possible with the type of casing in the hole and the acid pumping equipment being used.

When all of the acid has been displaced or when all of the duct-forming devices that will accept fluid flow have closed, the pressure in the wellbore is reduced. This will allow flow to occur from the formation into the wellbore and this flow will displace the check balls 262 allowing them to move into the wellbore or the casing, as seen in FIG. 15. The bulk of the balls 246 may be retreived with a "basket" assembly well known in the oil technology field, or they may be left in the bottom of the casing assuming that some length of blank casing is available between the lowest duct-forming device and the plugged back bottom of the hole.

While specific embodiments of the invention have been shown and described in detail to illustrate the application of the inventive principles, it will be understood that the invention may be embodied otherwise without departing from such principles.

What is claimed is:

1. A duct-forming device for use in well completion apparatus of the kind, wherein a bore hole casing is positioned in a bore hole and duct-forming devices of acid-resistant metal are secured at spaced levels of the casing in alignment with holes machined in the casing wall, and wherein, upon pressurizing the casing space, each duct-forming device is laterally extended from the casing for making contact with a producing formation, each of said duct-forming device comprising:

(a) a terminal sleeve adapted to make contact with the producing formation when the duct-forming device has been laterally extended, said terminal sleeve having passageway means for establishing communication between said formation and the interior space of said duct-forming device;

(b) a passage-forming removable piston assembly within said interior space of the duct-forming device and including means defining passages through said piston assembly and a piston means movable between I. an initial position in which the piston means permits fluid flow through the passageway means of (a);

II. a blocking position in which said piston means blocks fluid flow through said passageway means of (a); and III. an ultimate position in which the piston means and the entire piston assembly are forced from the interior space of said duct-forming device toward and into the casing space;

(c) an acid and/or alkali-soluble closure cap having hole means, said closure cap being mounted on said duct-forming device adjacent the end at which the duct-forming device is secured to said casing; and (d) an acid and/or alkali-soluble flow-impeding means located within the interior of said duct-forming device and being interpositioned between said closure cap (c) and said piston assembly (b), whereby acidic or alkaline liquid forced down said casing space impinges on and dissolves that closure cap, while simultaneously passing through said hole means of said closure cap to make contact with and dissolve said flow-impeding means, said liquid, after having eaten through said flow-impeding means flowing through the passages of said piston assembly and through the passageway means in said terminal sleeve into said formation while, depending on its flow rate and its pressure, said liquid gradually moves said piston means of said piston assembly from said initial position (I) into said blocking position (II) to block the communication between the formation and the interior of said duct-forming device, and after said liquid has substantially totally dissolved said flow-impeding means and said closure cap and the formation pressure exceeds the pressure within the interior of said duct-forming device, fluid from said formation forces said piston assembly, including the piston means, towards and into said casing space, said means defining passages through said piston assembly being configured to permit flow from one side of said piston to the opposite side thereof through said terminal sleeve (a) in a direction from said casing toward said formation when said flow-impeding means has been dissolved and when said piston means is in said initial position (I), said piston means including blocking means for blocking flow through said passageway means when said piston means is in said blocking position (II).

2. A duct-forming device as claimed in claim 1, wherein said flow-impeding means is made of magnesium, magnesium alloy, aluminum, aluminum alloy, zinc or zinc alloy.

3. A duct-forming device as claimed in claim 1, wherein said closure cap is made of zinc, alloy, aluminum or alluminum alloy.

4. A duct-forming device as claimed in claim 1, wherein said hole means of said closure cap comprises a substantially centrically located hole and at least one additional hole spaced from said centrally located hole to facilitate the flow of gases evolved during the dissolution of said closure cap and/or said flow-impeding means.

5. A duct-forming device as claimed in claim 1, wherein the interior space of the duct-forming device is filled with a viscous liquid when said piston means is in said initial position (I), thereby to prevent entry of substances from said formation through said passageway means of the terminal sleeve.

6. A duct-forming device as claimed in claim 1, wherein said flow-impeding means is a plate member screwed into said duct-forming device between said piston assembly and said closure cap.

7. A duct-forming device as claimed in claim 1, wherein the closure cap is screwed onto said duct-forming device.

8. A duct-forming device as claimed in claim 1, wherein the duct-forming device is at least partially made of hardened steel.

9. A duct-forming device as claimed in claim 1, wherein abrasion resistant liner means are provided for lining the flow passages of the duct-forming device.

10. A duct-forming device according to claim 1 wherein said piston assembly includes: a check disc defining a valve seat, said check disc being interposed between said piston means and said flow-impeding means and defining orifice means through which fluid may flow: closure means formed on said piston means and adapted to be seated against said valve seat to close said orifice means to prevent fluid flow therethrough; and spring means biasing said piston means in a direction to seat said closure means on said seat means; said piston means being moved from said seated position to said initial position (I) when the fluid pressure of said liquid overcomes the spring pressure of said spring means.

11. A duct-forming device as claimed in claim 1, wherein said passageway means of said terminal sleeve is formed in a plug which, except for said passageway means, closes said terminal sleeve, said plug being made of acid and/or alkali soluble metal.

12. A duct-forming device as claimed in claim 11, wherein the exterior surface of said plug and the free extremity of said terminal sleeve are substantially flush with each other.

13. A duct-forming device as claimed in claim 11, wherein said terminal sleeve and said plug have interengaging thread means, said plug being screwed into the thread means of said terminal sleeve, said thread means having sufficient play so as to permit at least a trickle of fluid flow therethrough.

14. A duct-forming device as claimed n claim 1, wherein said piston assembly includes said piston means having passages, spring means, and first and second abutment or shoulder means, said spring means being located between said first and second abutment means, said spring means normally urging said piston means toward said flow-impeding means, said piston means being moved from said initial position (I) into said blocking position (II) when the fluid pressure of said liquid is greater than the spring pressure of said spring means.

15. A duct-forming device as claimed in claim 14, wherein said piston means includes chamber means, a ball being located within said chamber means, seat means being provided within said chamber means for said ball, whereby fluid entering from the formation through said passageway means of said terminal sleeve forces said ball against said seat means to build up pressure, to move said piston assembly towards and into said casing space.

16. A duct-forming device as claimed in claim 14, wherein said first abutment means is press-fitted into said terminal sleeve, while said second abutment means is formed on said piston means.

17. A duct-forming device according to claim 1 wherein said piston assembly includes bleeder means extending through said piston means for permitting a predetermined quantity of fluid flow through said passageway means when said piston means is in said blocking position (II).

18. A duct-forming device according to claim 17 wherein said bleeder means comprises orifice means extending through the body of said piston means and forming a communicating flow path from one side of said blocking means to the other to form a bypass bleeder passage past said blocking means.

19. A duct-forming device according to claim 1 wherein said piston means comprises a fluted configuration with said passages through said piston assembly being defined between said fluted piston means and the wall defining said passageway means of said terminal sleeve.

20. A duct-forming device according to claim 19, wherein said piston means comprises a generally cylindrical main body having a plurality of radially extending circumferentially spaced flutes formed thereon with said flutes having a radially outermost wall with a curvature generally coincident with the wall defining said passageway means in said terminal sleeve, said passages through said piston assembly being defined between and bounded by said flutes, said piston main body and said terminal sleeve wall.

21. A duct-forming device according to claim 20, wherein said cylindrical main body of said piston means includes a forward nose portion constituting said blocking means of said piston means, said forward nose portion coming into engagement with said terminal sleeve to block said passageway means when said piston is in said blocking position (II).

22. A duct-forming device according to claim 21, including bleeder means extending through said piston means for permitting a predetermined quantity of fluid flow to occur through said passageway means when said piston means is in said blocking position (II), said bleeder means comprising a bleeder passage by-passing the engagement between said forward nose portion of said piston means and said terminal sleeve.

23. A duct-forming device for use in well completion apparatus of the kind wherein a bore hole casing is positioned in a bore hole and duct-forming devices of acid-and abrasion-resistant metal are secured at spaced levels to the casing in alignment with holes machined in the casing wall, and wherein, upon pressurizing the casing space, each duct-forming device is laterally projected from the casing for making contact with a producing formation, each said duct-forming device comprising:

(a) a terminal sleeve adapted to make contact with the producing formation when the duct-forming device has been laterally projected;

(b) a plug of acid-and/or alkaline soluble material positioned at the free end of said terminal sleeve and having at least one passage for establishing communication between said formation and the interior space of said duct-forming device;

(c) a removable piston assembly within said interior space of the duct-forming device and including a piston having passages therethrough and blocking means thereon, said piston being movable between an initial position in which the piston passages permit fluid flow through the passage of said plug, a blocking position in which the piston blocking means blocks fluid flow through the passage of said plug and an ultimate position in which the piston and the entire piston assembly are forced from the interior of said duct-forming device into the casing space, said piston assembly further including a spring, first and second abutment means removably mounted in said terminal sleeve, said spring bearing against said first and second abutment means for holding said piston in said initial position, said piston assembly further including a chamber adjacent said casing, ball means located within said chamber and seat means, within such chamber for said ball means;

(d) an acid- and/or alkali soluble closure cap screwed on to said duct-forming device at its end which is secured to said casing and having at least one hole;

(e) an acid- and/or alkali soluble flow-impeding plate screwed into said duct-forming device between piston assembly and said closure cap, and (f) sealing means permitting said movements of said piston within the interior of the duct-forming device in a fluid-tight manner.

24. A duct-forming device as claimed in claim 23, wherein the interior of said duct-forming device is filled with a viscous liquid when said piston is in said initial position.

25. A duct-forming device for use in well completion apparatus of the kind wherein a bore hole casing is positioned in a bore hole and duct-forming devices of acid-resistant metal are secured at spaced levels of the casing in alignment with holes machined in the casing wall, and wherein upon pressurization of the casing space each duct-forming device is laterally extended from the casing for making contact with a producing formation, each of said duct-forming device comprising:

(a) a terminal sleeve adapted to make contact with the producing formation when the duct-forming device has been laterally extended, said terminal sleeve having an internal wall defining passageway means for establishing communication between said formation and the interior space of said duct-forming device;

(b) a check member made of acid and/or alkali soluble material mounted within said passageway means forming a restriction therein limiting fluid flow therethrough to a predetermined initial amount, with dissolution of said check member as a result of exposure thereof to acid and/or alkali liquid operating to remove said restriction;

(c) an acid and/or alkali-soluble closure cap having hole means, said closure cap being mounted in said duct forming device adjacent the end at which the duct-forming device is secured to said casing;

(d) an acid and/or alkali soluble flow-impeding means located within the interior of said duct-forming device and being interpositioned between said closure cap (c) and said check member (b);

(e) a non-soluble ball check member interpositioned between said flow-impeding means (d) and said check member; and (f) seat means within said terminal sleeve passageway means adapted to have said ball check member seated thereupon to block fluid flow through said passageway means in a direction from said casing toward said formation;

with acidic or alkaline liquid forced down said casing operating to impinge upon and dissolve said closure cap while simultaneously passing through said hole means of said closure cap to make contact with and dissolve said flow-impeding means, said liquid, after having eaten through said flow-impeding means flowing through said restricted passageway means into said formation while, depending upon its flow rate and its pressure, said liquid gradually dissolves said check member, with complete dissolution of said check member operating to effect movement of said ball check member into seated engagement with said seat means to block communication between the formation and the interior of said duct-forming device, and after said liquid has substantially totally dissolved said flow-impeding means, said check member and said closure cap and the formation pressure exceeds the pressure within the interior of said duct-forming device, fluid from said formation forces said ball check member off said seat means and towards and into said casing space.

26. A duct-forming device according to claim 25 wherein said check member has an outer configuration slightly smaller than said passageway means to provide a spacing between said check member and said internal wall defining said passageway means thereby to permit restricted fluid flow through said passageway means and through said casing.

27. A duct-forming device according to claim 25, wherein said ball check member is formed in a spherical configuration having a relatively rigid core with a resilient covering.

28. A ball check member according to claim 25, wherein said flow-impeding member is a plate member screwed into said duct-forming device and holding said check member and said ball check member in place within said terminal sleeve.

29. A duct-forming device according to claim 25, wherein said check member is interpositioned between said ball check member and said seat means to obstruct seating of said ball check member until dissolution of said check member.

30. A duct-forming device according to claim 29, wherein said ball check member is positioned adjacent said check member on the side thereof closest to said casing and wherein said seat means is formed adjacent said check member on the side thereof closest said formation.

31. A duct-forming device according to claim 25, wherein said check member is formed with an outer portion and an inner portion, said outer portion being constituted of material which is soluble in said acid and/or alkaline liquid at a slower rate than said inner portion.

32. A duct-forming device according to claim 31, wherein said outer portion of said check member comprises a plastic coating.

33. A duct-forming device according to claim 31, wherein said outer portion of said check member comprises a metal alloy.

34. A duct-forming device according to claim 25, wherein the material of said check member is selected to be of an acid and/or alkaline soluble composition having a dissolution rate which effects passage of a predetermined total volume of fluid through said passageway means before seating of said ball check member upon said seat means.

35. A duct-forming device according to claim 34, wherein said check member is composed of a zinc-tin-lead-copper alloy which dissolves within about two hours of exposure to acid and/or alkaline liquid.

36. A duct-forming device according to claim 34, wherein the composition and structure of said check member is selected to effect an initial flow rate of about two gallons per minute prior to dissolution of said check member and a final flow rate of about 42 gallons per minute through said passageway means after dissolution of said check member.

37. A duct-forming device according to claim 34, wherein said composition and structure of said check member are selected to effect an average flow rate of about 20 gallons per minute to said passageway means between commencement of dissolution of said check member and seating of said ball check member.

38. A duct-forming device according to claim 34, wherein the total volume of flow of acid and/or alkaline liquid through said duct-forming device between initiating of such flow and seating of said ball check member to terminate such flow is about 2400 gallons.

* * * * *